US007201562B2

(12) United States Patent
Liu et al.

(10) Patent No.: US 7,201,562 B2
(45) Date of Patent: Apr. 10, 2007

(54) FAN WITH CENTRAL INTAKE

(75) Inventors: Wen-Hao Liu, Taipei (TW); Chu-Hsien Chou, Taipei (TW)

(73) Assignee: Asia Vital Component Co., Ltd., Kaohsiung (TW)

( * ) Notice: Subject to any disclaimer, the term of this patent is extended or adjusted under 35 U.S.C. 154(b) by 121 days.

(21) Appl. No.: 10/979,205

(22) Filed: Nov. 3, 2004

(65) Prior Publication Data

US 2006/0093475 A1 May 4, 2006

(51) Int. Cl.
*F04D 29/32* (2006.01)

(52) U.S. Cl. ..... 415/176; 415/221

(58) Field of Classification Search ..... 415/176, 415/211.2, 221; 416/193 A; 361/695; 165/80.3
See application file for complete search history.

(56) References Cited

U.S. PATENT DOCUMENTS 3,449,605 A * 6/1969 Wilson ..... 310/58
6,003,866 A * 12/1999 Tsai ..... 273/126 A
6,382,306 B1 * 5/2002 Hsu ..... 165/80.3
6,386,276 B1 * 5/2002 Chen et al. ..... 165/121
6,910,862 B2 * 6/2005 Horng et al. ..... 415/211.2
6,951,449 B2 * 10/2005 Huang et al. ..... 417/368
7,037,089 B2 * 5/2006 Hsieh ..... 417/368

* cited by examiner

*Primary Examiner*—Edward K. Look
*Assistant Examiner*—Nathan Wiehe

(57) ABSTRACT

A fan with central intake comprises a fan frame, a fan wheel and a fan motor. The fan frame provides a hub seat with an annular spacing for fluid flowing through and a joining part at the center of the hub seat for supporting the bearings. The fan wheel is received in the fan frame and provides a hub with an open side and a hollow side with a circular opening. The annular spacing associated with the circular opening constitutes a central flow route for admitting fluid to pass through such that heat from the central area of a radiator under the fan can be dissipated efficiently.

3 Claims, 17 Drawing Sheets

FIG 3 (PRIOR ART)
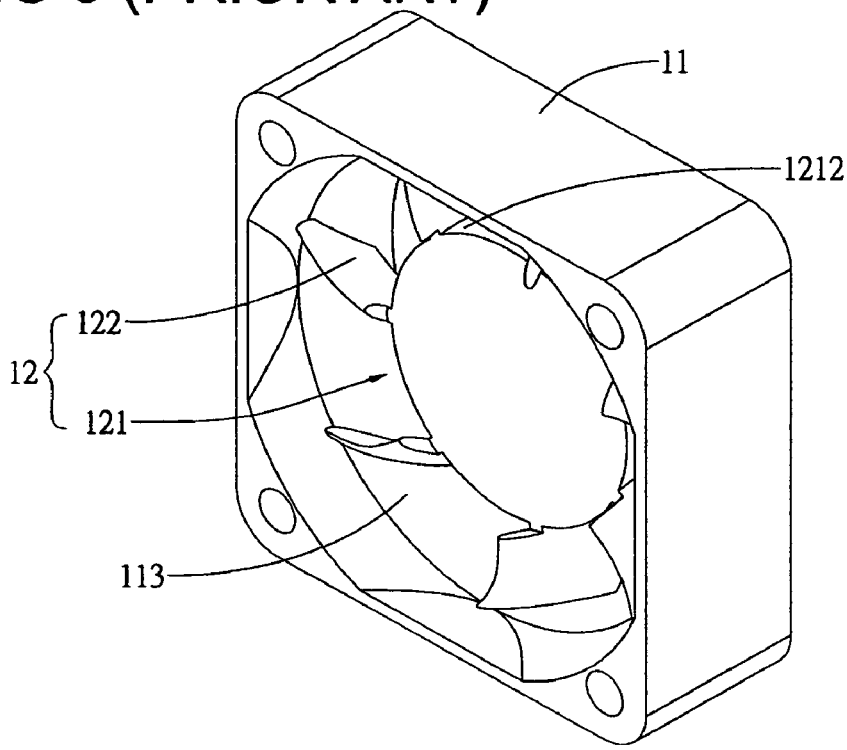
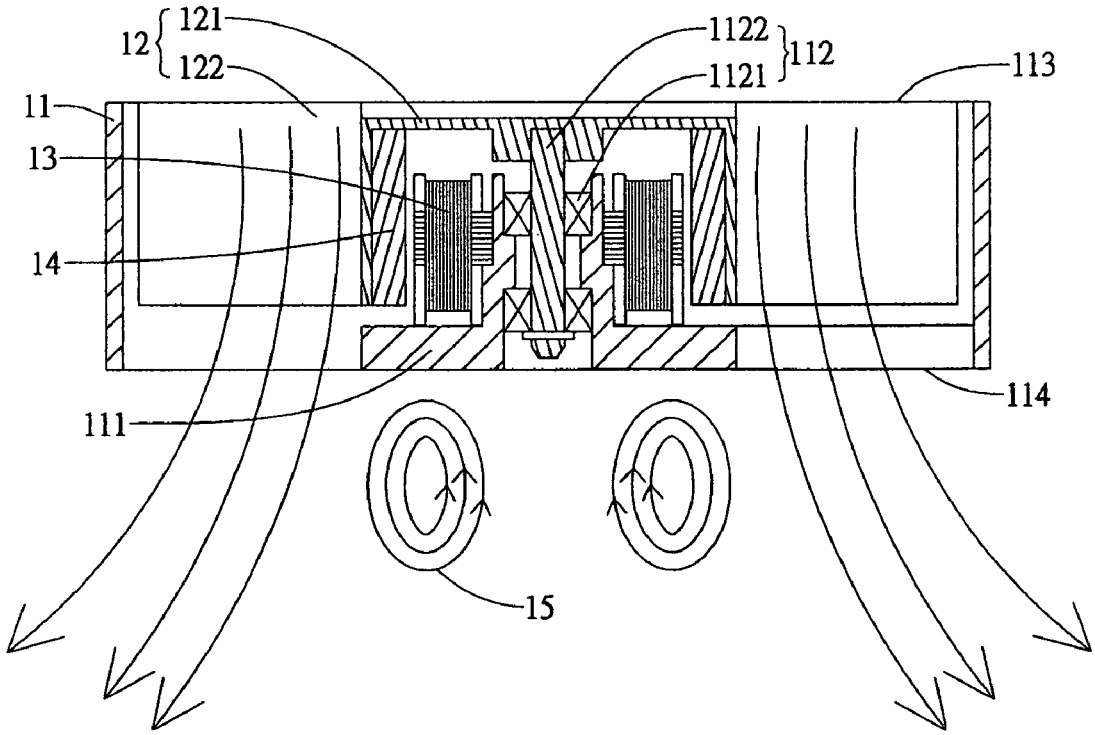
FIG 4 (PRIOR ART)

FIG 6
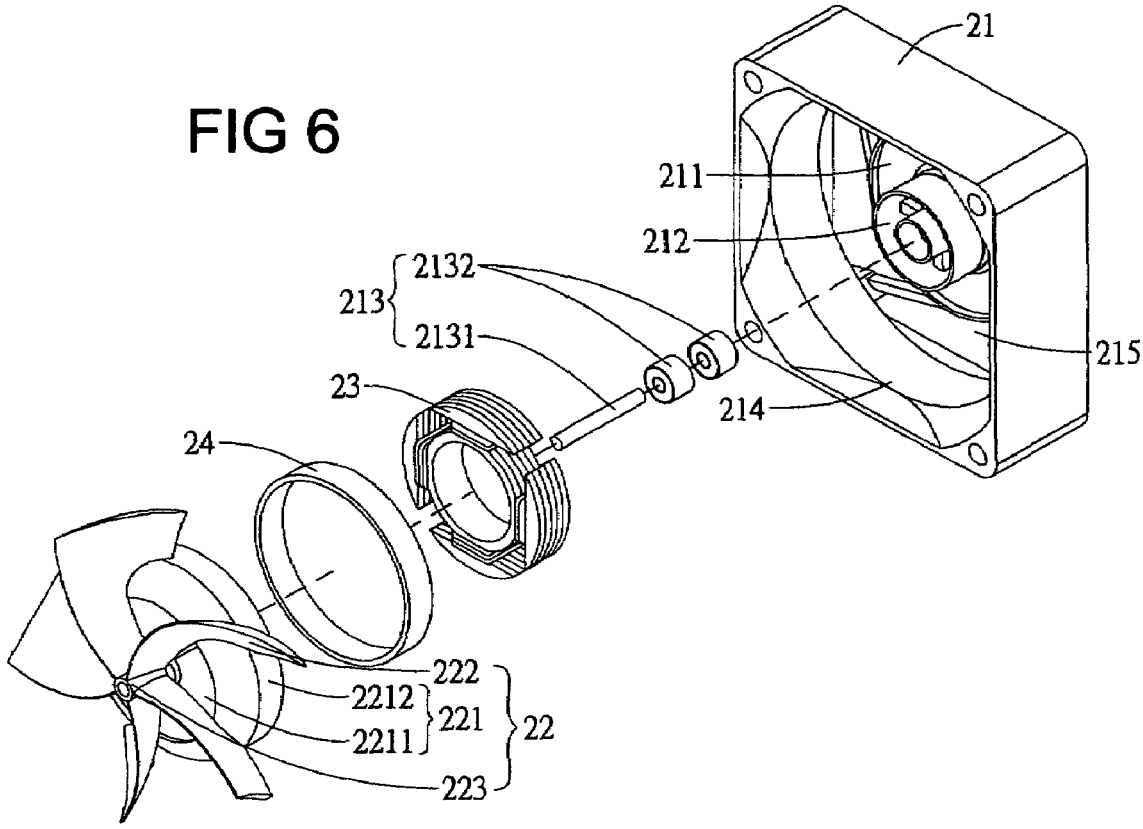
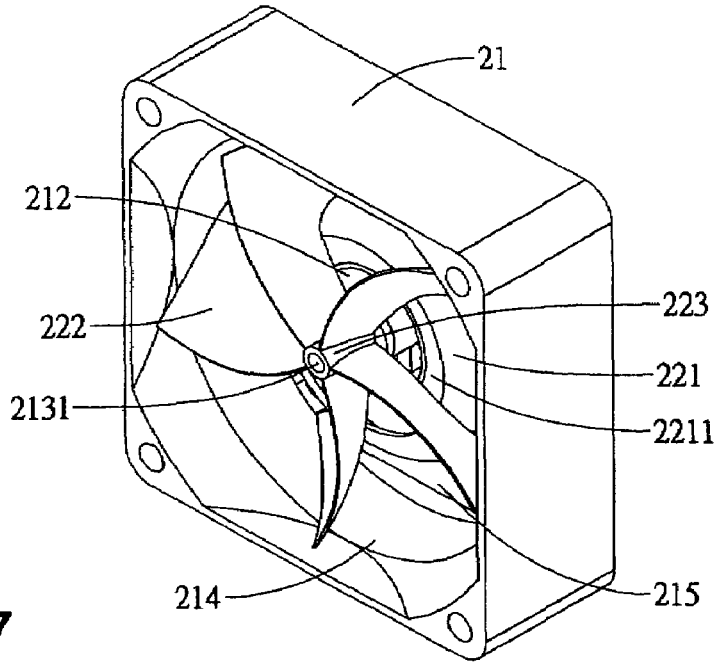
FIG 7

FIG 8
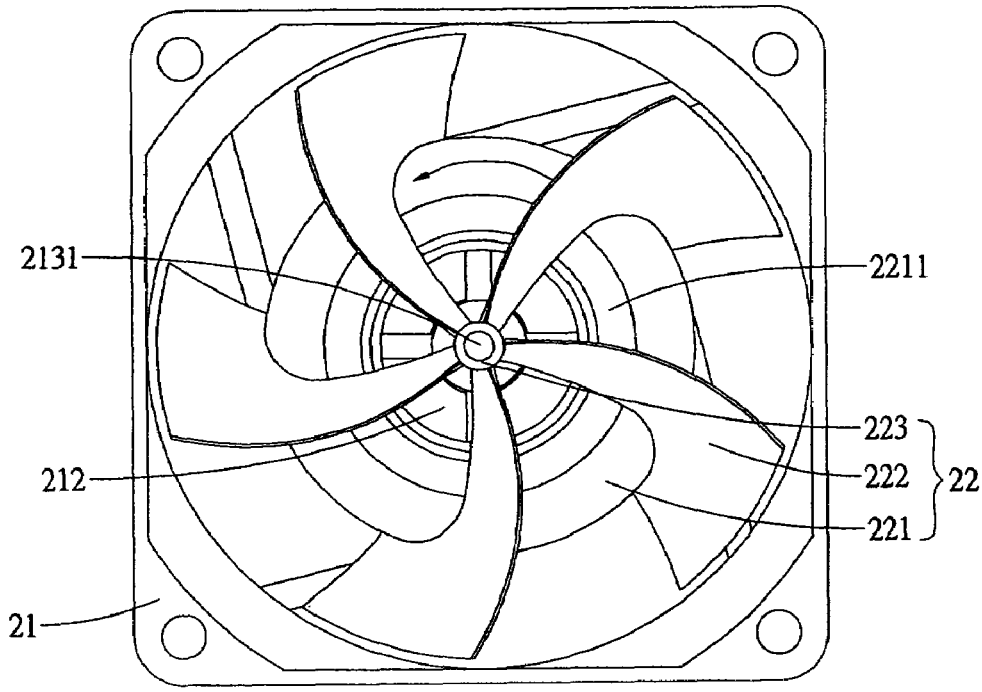
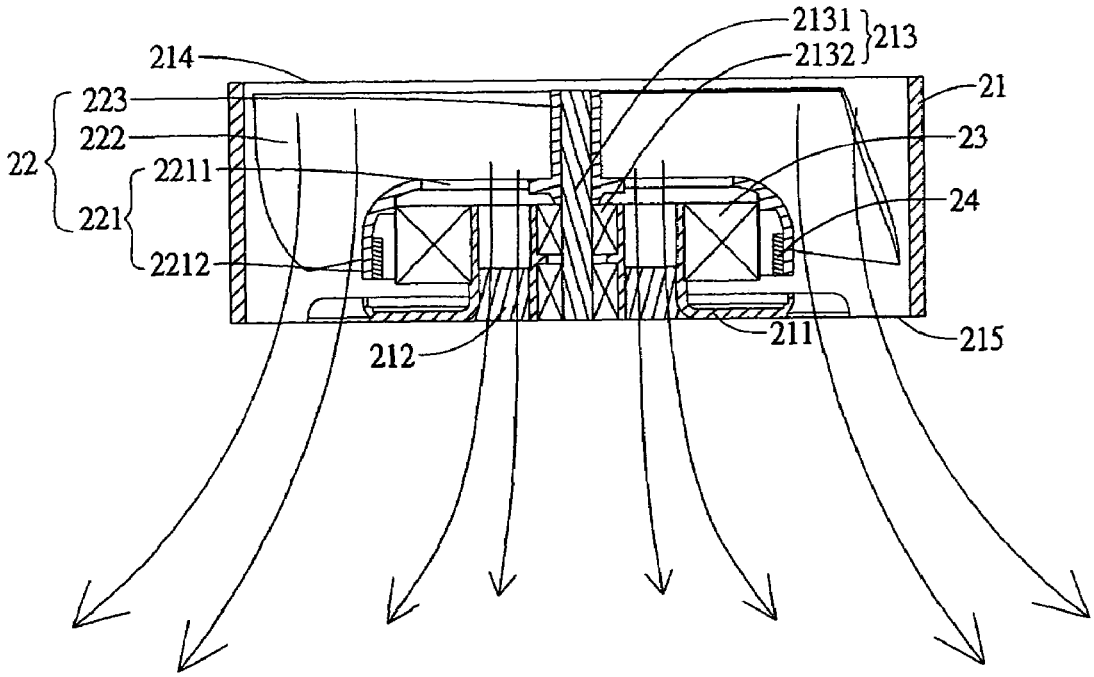
FIG 9

FIG 10
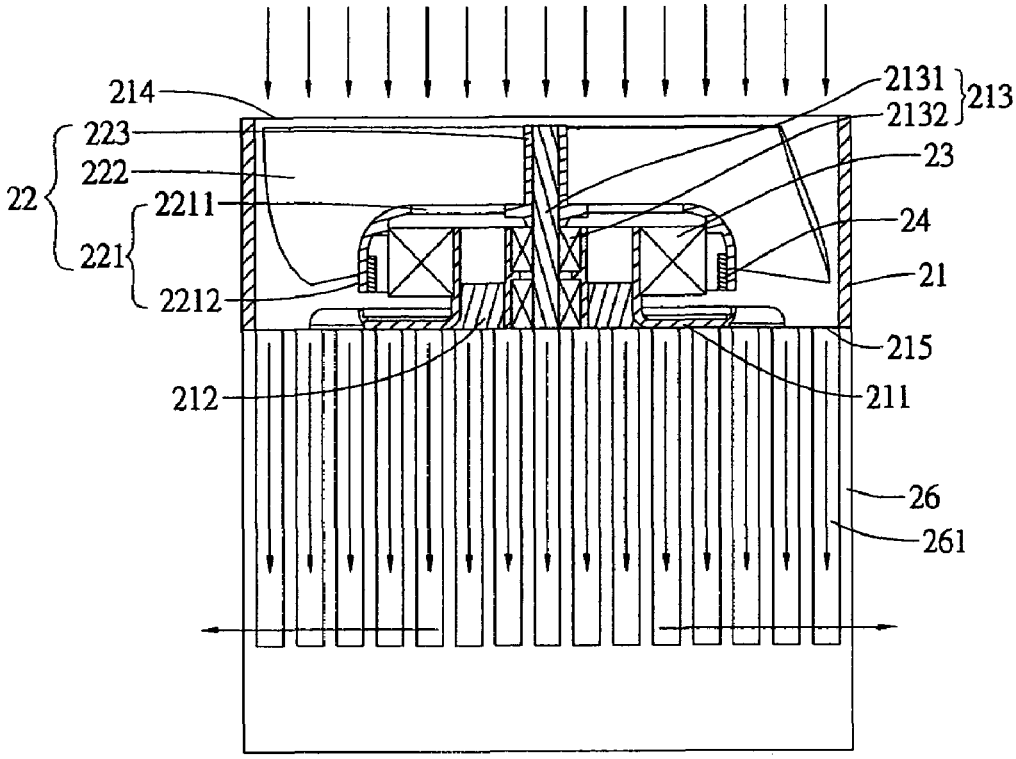
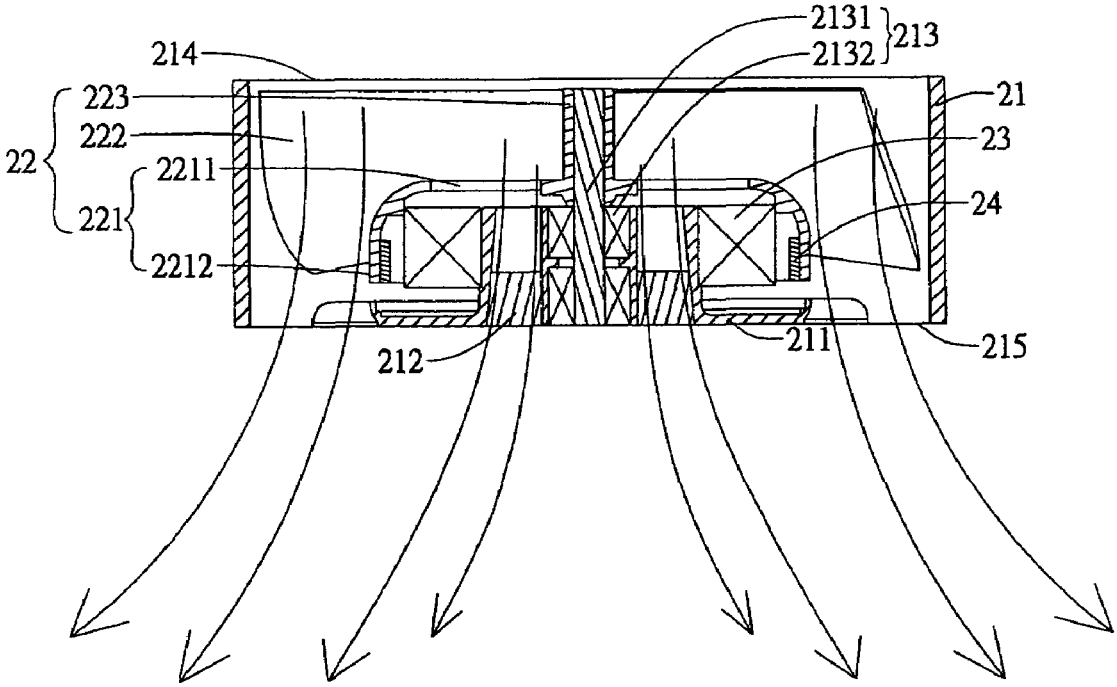
FIG 11

FIG 14
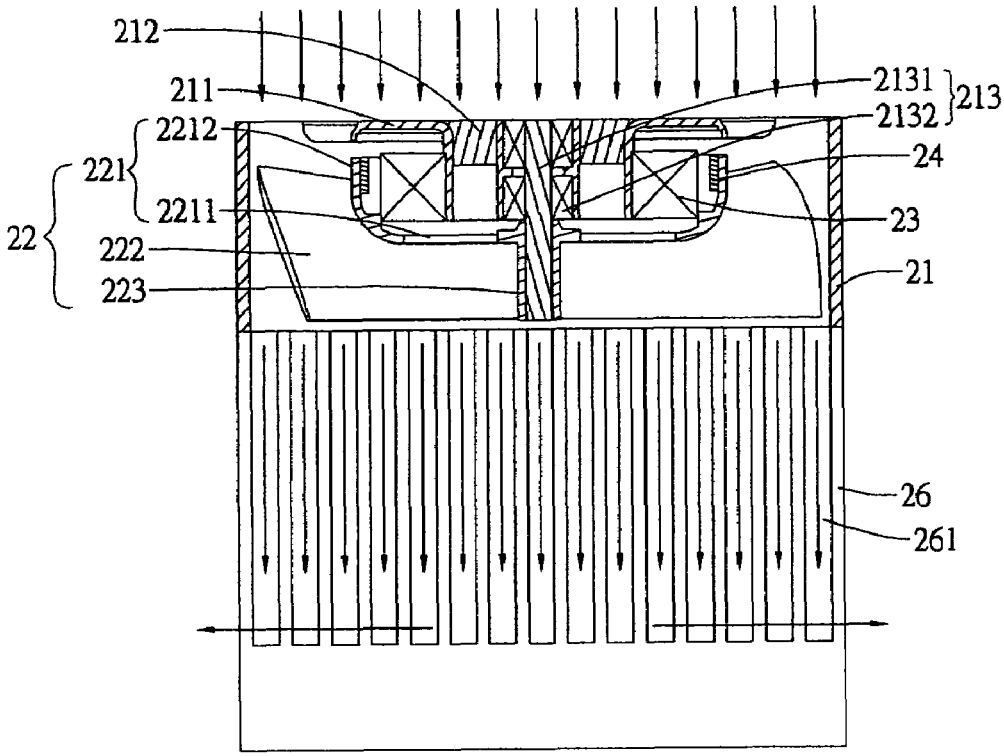
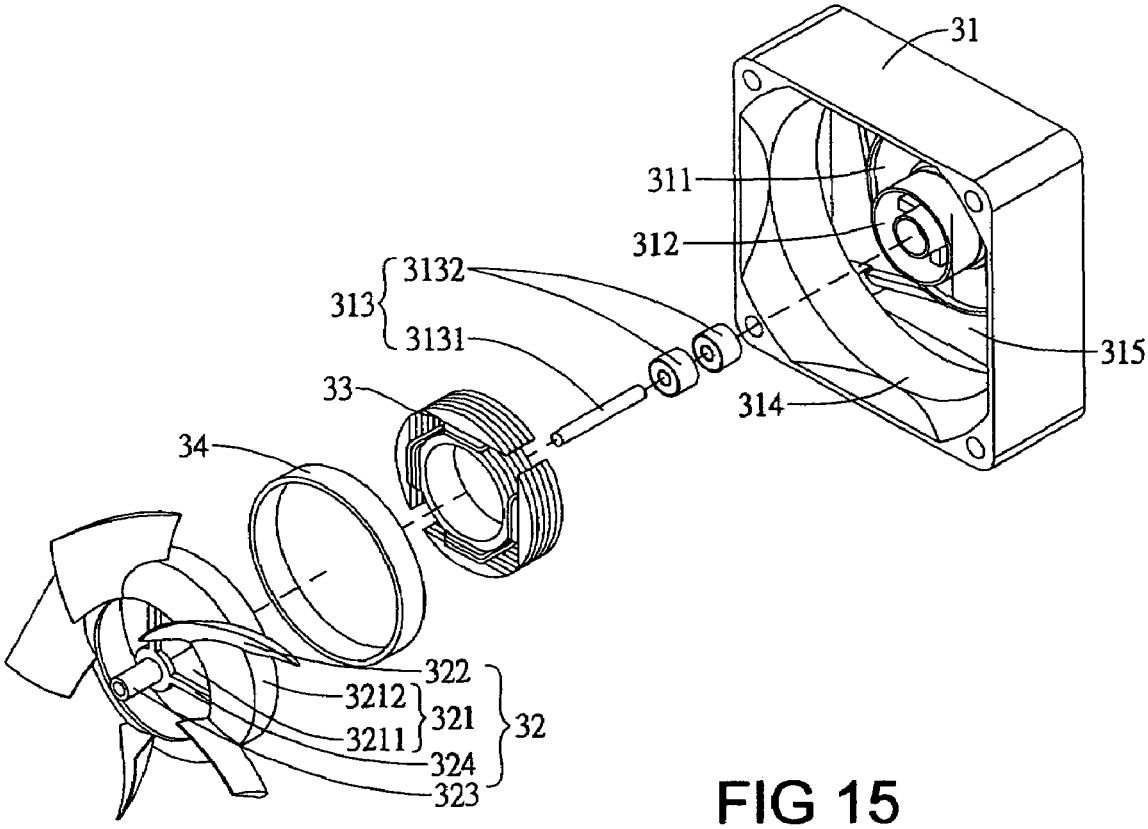
FIG 15

FIG 16
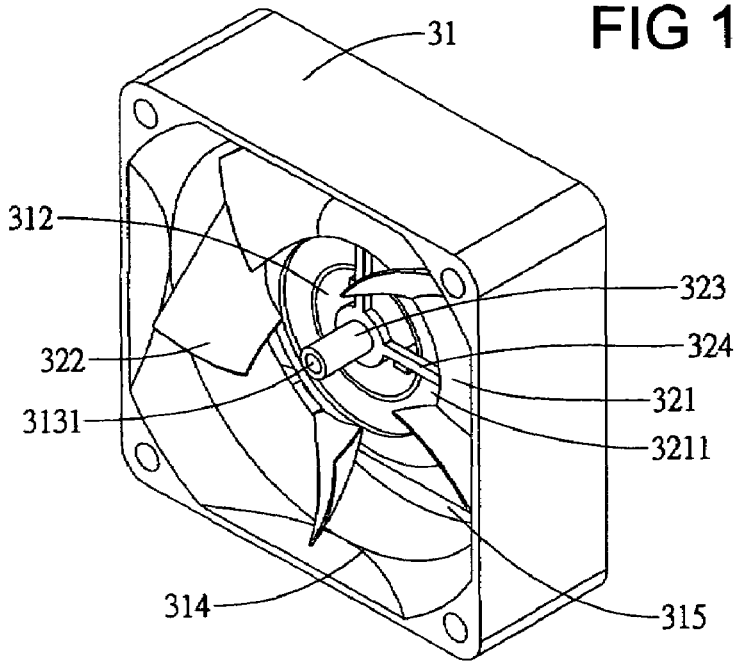
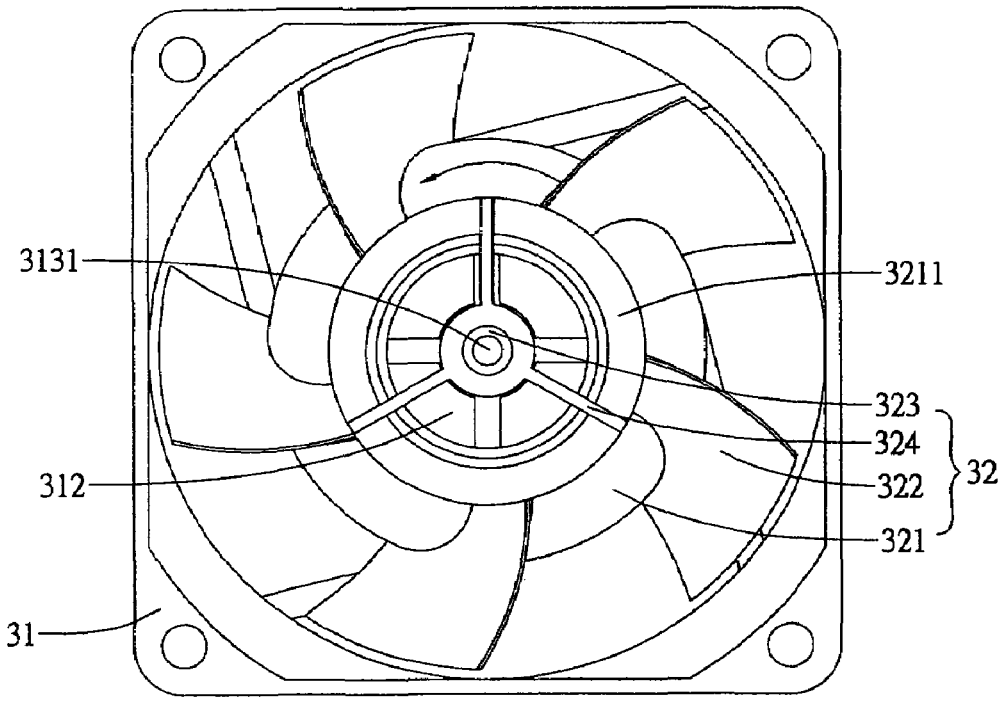
FIG 17

FIG 20
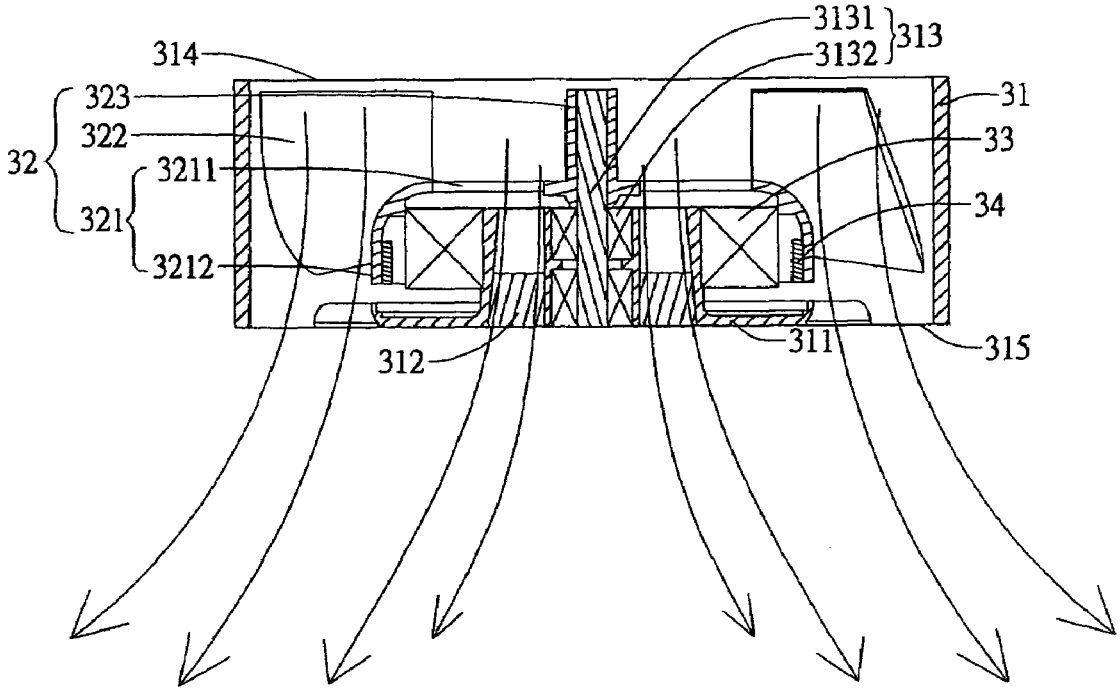
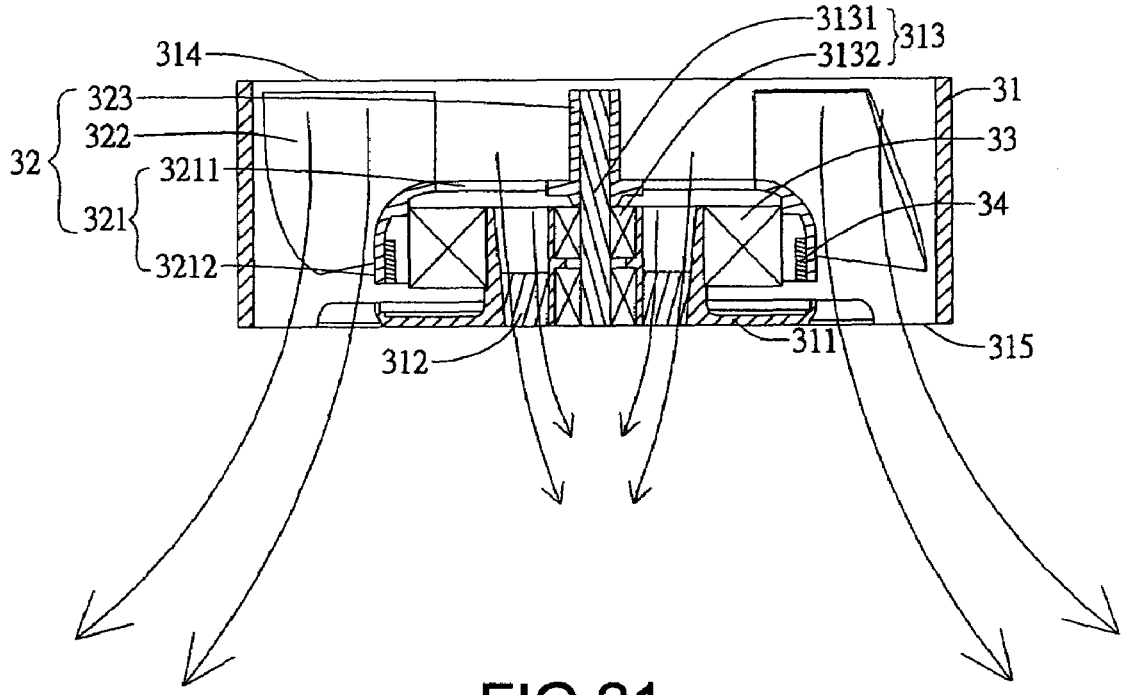
FIG 21

FIG 22
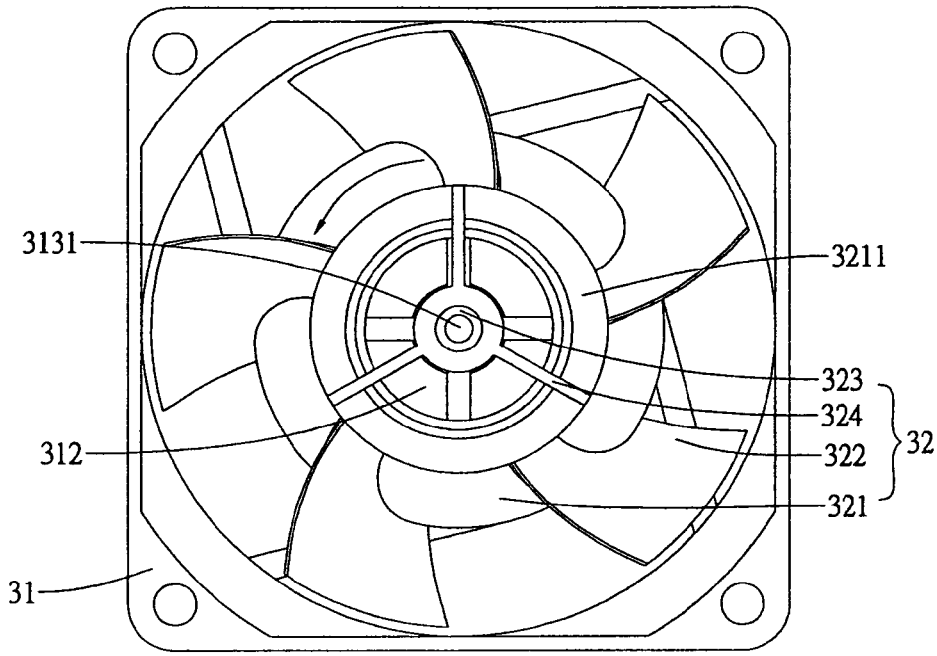
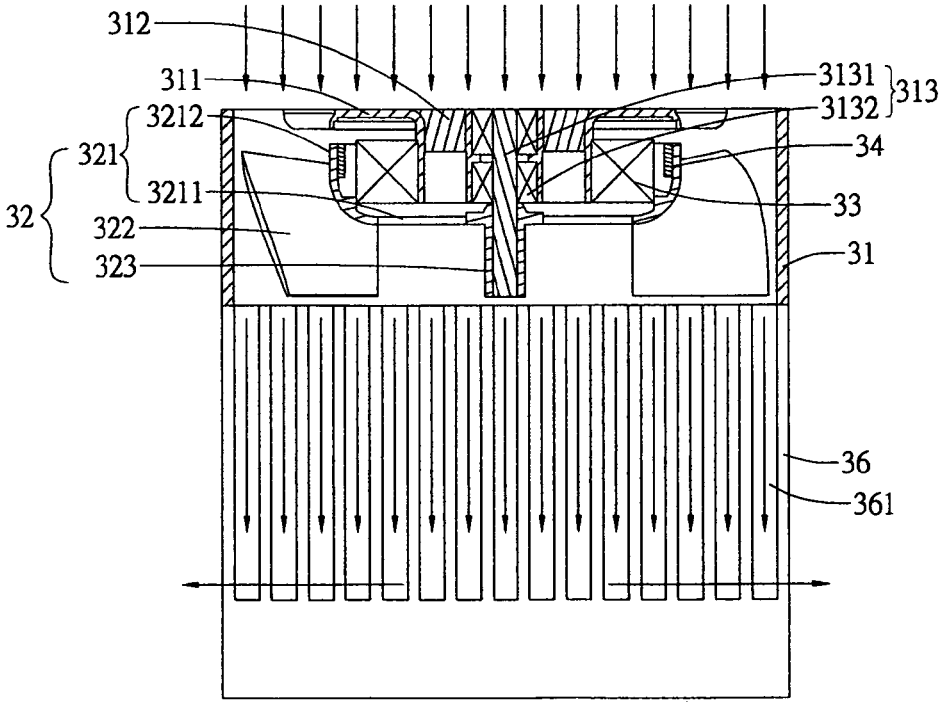
FIG 23

FIG 24
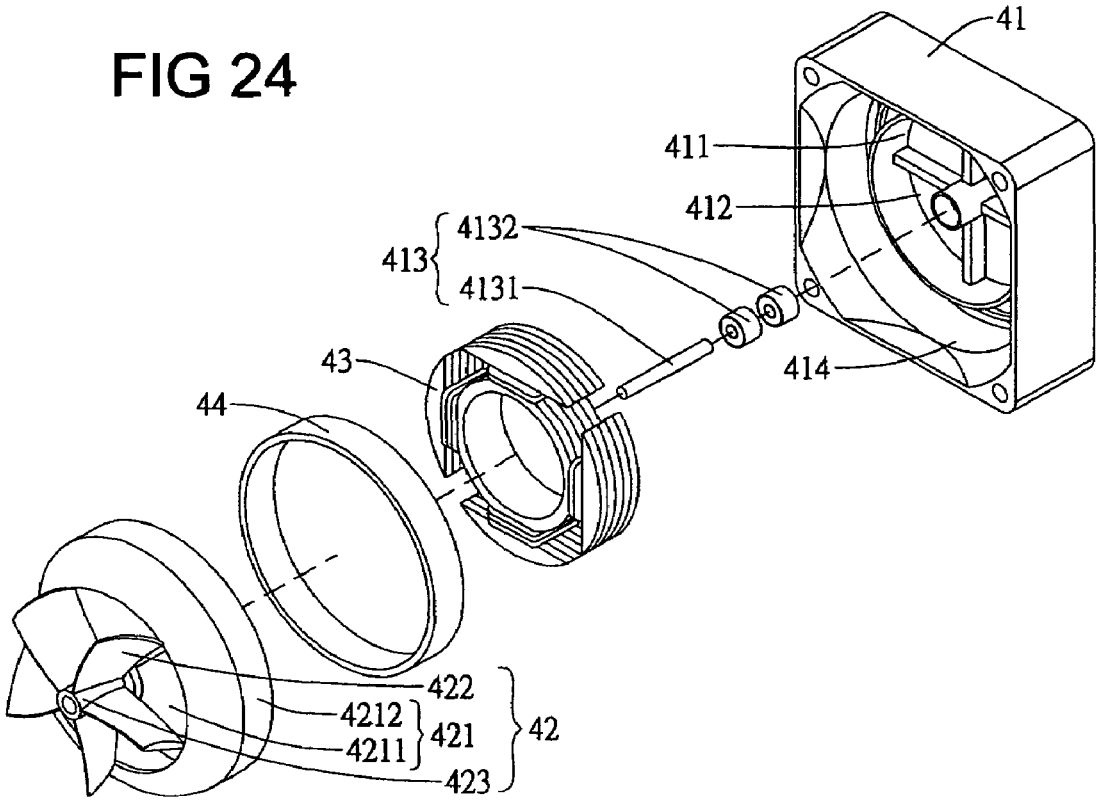
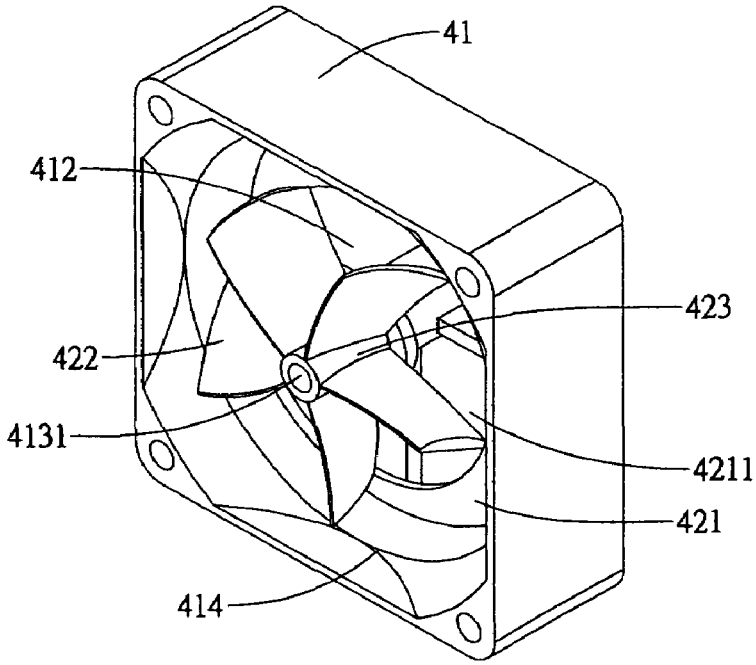
FIG 25

FIG 30
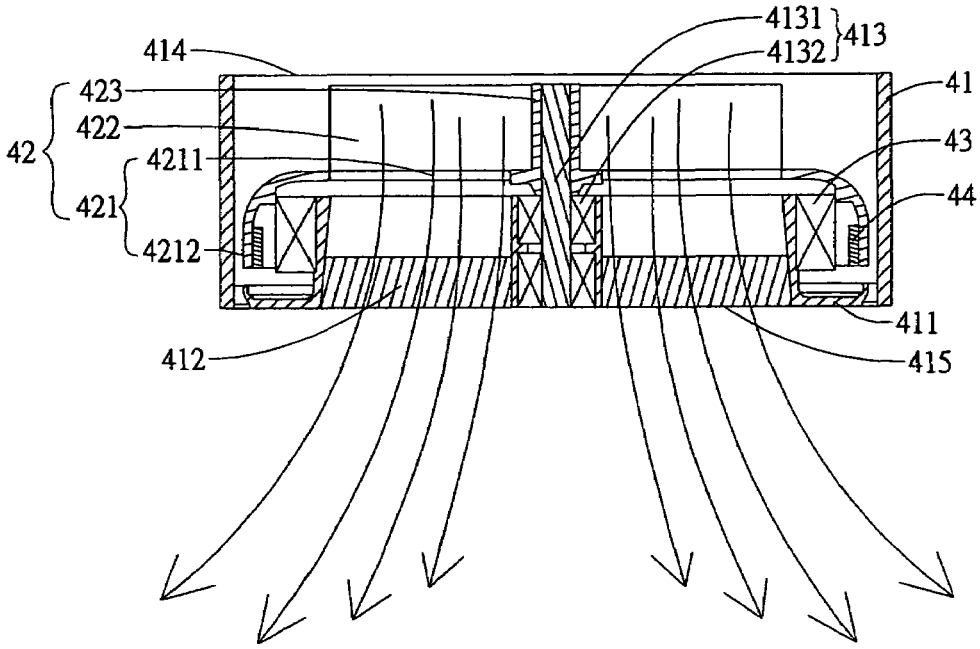
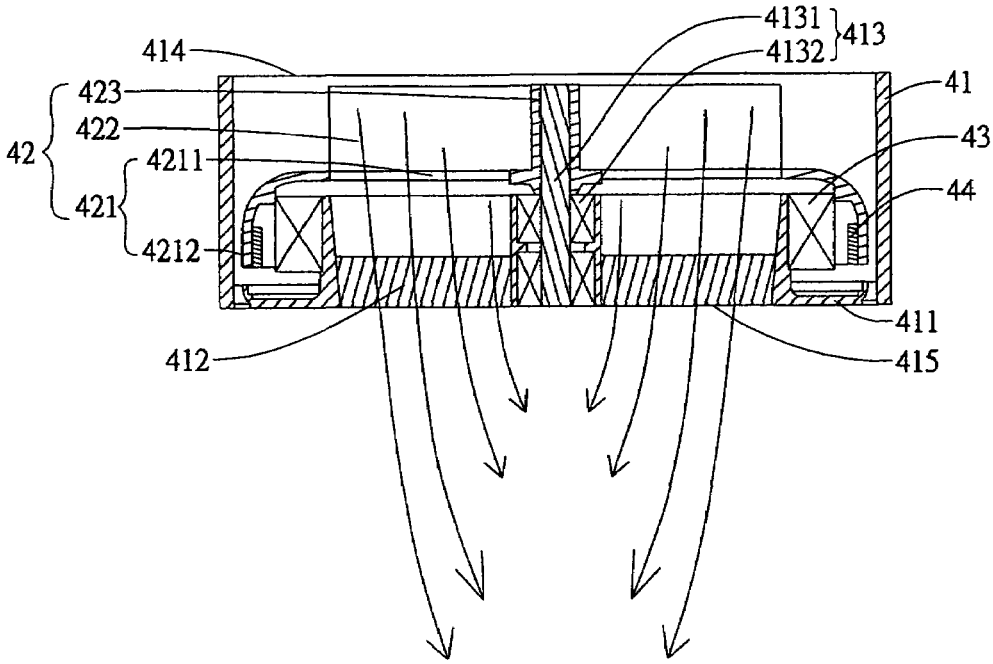
FIG 31

FIG 32
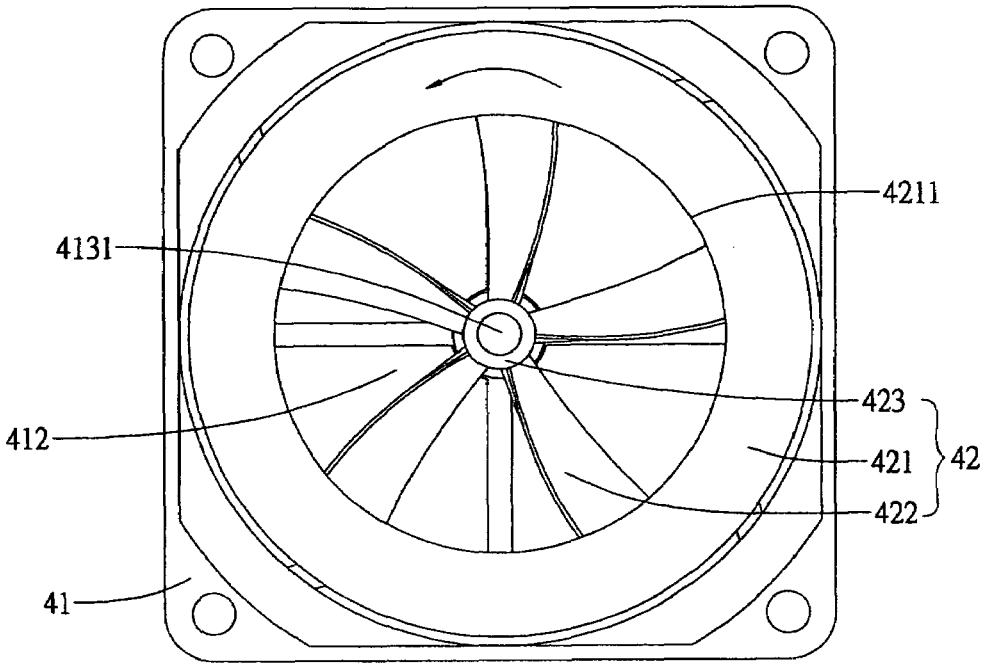
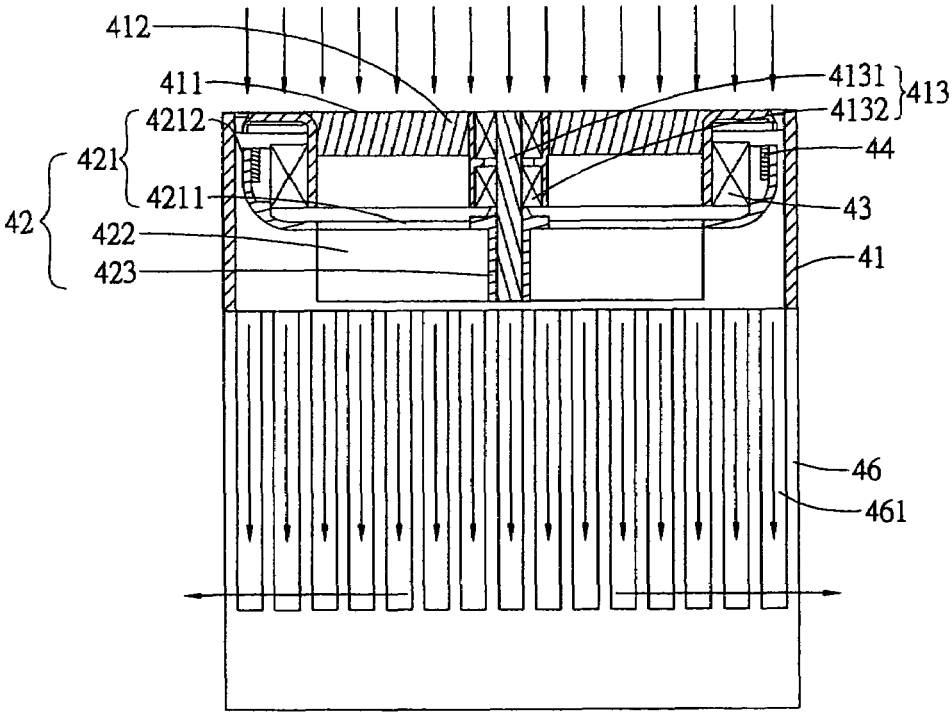
FIG 33

FAN WITH CENTRAL INTAKE

BACKGROUND OF THE INVENTION

1. Field of the Invention

The present invention is related to a fan with central intake and particularly to a fan frame with a fan wheel for dissipating heat in an electronic product.

2. Brief Description of the Related Art

Due to development of electronic technology, the central processor is operated with high time pulse to satisfy requirement of high executing speed. However, the central processor with high speed of data processing accompanies with much more heat generation too.

In order to dissipate the heat, it is necessary to provide a heat dissipation device. Otherwise, the central processor will be shutdown resulting from overheat if there is no excellent heat dissipation device.

Currently, the most popularly used heat dissipation device is the cooling fan because of its low cost. This is why the manufacturers are interested in developing and researching the fan.

But, the main unit of a computer provides a limited space for the fan being located so that how to promote function of heat dissipation with a fan in proper size becomes relatively significant.

Further, referring to FIGS. 1 to 4, the known fan includes a fan frame 11 and a fan wheel 12. The fan frame 11 provides a hub seat 111 with a joining part 112 at the center thereof. The joining part 112 is composed of a bearing 1121 and a spindle 1122. An inlet 113 and an outlet 114 are provided at the fan frame 11 for fluid moving in and out. The hub seat 111 is attached with a motor stator 13. The fan wheel 12 includes a hub 121 and blades 122 with a receiving part 1213 on the hub 121. A motor rotor 14 is arranged at the inner annular surface 1211 of the hub 121 and the blades 122 radially extend outward from the outer annular surface 1212 of the hub 121. The receiving part 1213 of the hub 121 is movably attached to joining part 112 of the hub seat 111 such that the rotor 14 can align with the stator 13 and the fan wheel 12 can be fitted in the fan frame.

When the stator 13 is powered on to magnetize the rotor 14, the fan wheel 12 can rotate about the joining part 12 and the blades 122 can drag the fluid to move inward via the inlet 113 and move outward via the outlet 114.

Referring to FIGS. 4 and 5, the fan frame 11 and the fan wheel 12 are mounted to the top of a radiator 16. When the fan wheel 12 rotates, the fluid is actuated to flow inward via the inlet 113 and blow toward the radiator 16 at the outlet 114 and then moves outward through air clearances 161 of the radiator 16. The problem created by the conventional fan is that the fluid does not flow toward the rear side of the hub seat 111 and a stagnation zone 15 is created at the rear side of the hub seat 111 while the fluid flows outward and disperses toward periphery of the fan frame. As a result, heat at the center of the radiator 16 is incapable of being dissipated and the heat dissipation capability becomes lowered.

Further, action between the stator 13 and the rotor 14 and rotation of the bearing 1121 are sources of heat generation, which influence heat dissipation efficiency and life span of the fan. Obviously, the conventional fan does not provide a way to discharge the heat sources and it is the reason of the conventional fan provides unfavorable effect of heat dissipation.

SUMMARY OF THE INVENTION

A primary object of the present invention is to provide a fan with central intake in which a flow route is disposed at the center of the fan to reduce a stagnation zone produced by the fan and so as to remove heat from an article being cooled and enhance heat dissipation effectively.

Another object of the present invention is to provide a fan with central intake in which a flow route is disposed at the center of the fan to remove beat from a joining part and a driving device so as to enhance operation efficiency of the fan.

BRIEF DESCRIPTION OF THE DRAWINGS

The detail structure, the applied principle, the function and the effectiveness of the present invention can be more fully understood with reference to the following description and accompanying drawings, in which:

FIG. 3 is an assembled perspective view of the conventional fan;

FIG. 4 is a sectional view of the conventional fan illustrating the air being moved during the fan being in operation;

FIG. 6 is an exploded perspective view of the first embodiment of a fan with central intake according to the present invention;

FIG. 7 is an assembled perspective view of the first embodiment of a fan with central intake according to the present invention;

FIG. 8 is a top view of the first embodiment of a fan with central intake according to the present invention;

FIG. 9 is a sectional view of the first embodiment of a fan with central intake according to the present invention illustrating the air being moved during the fan being in operation;

FIG. 10 is a sectional view of the first embodiment of the fan associated with a radiator according to the present invention;

FIG. 11 is a sectional view illustrating the second type passage of the hub in the first embodiment of a fan with a radiator according to the present invention;

FIG. 14 is a top view illustrating the fan blade in the first embodiment of a fan with a radiator according to the present invention having a twist angle turning left;

FIG. 15 is an exploded perspective view of the second embodiment of a fan with central intake according to the present invention;

FIG. 16 is an assembled perspective view-of the second embodiment of a fan with central intake according to the present invention;

FIG. 17 is a top view of the second embodiment of a fan with central intake according to the present invention;

FIG. 20 is a sectional view illustrating the second type passage of the hub in the second embodiment of a fan with a radiator according to the present invention;

FIG. 21 is a sectional view illustrating the third type passage of the hub in the second embodiment of a fan with a radiator according to the present invention;

FIG. 22 is a top view illustrating the fan blade in the second embodiment of the present invention having a twist angle turning left;

FIG. 23 is a top view illustrating the fan blade in the first embodiment of a fan with a radiator according to the present invention having a twist angle turning left;

FIG. 24 is an exploded perspective view of the third embodiment of a fan with central intake according to the present invention;

FIG. 25 is an assembled perspective view of the third embodiment of a fan with central intake according to the present invention;

FIG. 30 is a sectional view illustrating the second type passage of the hub in the third embodiment of a fan with a radiator according to the present invention;

FIG. 31 is a sectional view illustrating the third type passage of the hub in the third embodiment of a fan with a radiator according to the present invention;

FIG. 32 is a top view illustrating the fan blade in the third embodiment of the present invention having a twist angle turning left; and FIG. 33 is a top view illustrating the fan blade in the third embodiment of a fan with a radiator according to the present invention having a twist angle turning left.

DETAILED DESCRIPTION OF THE INVENTION

Figure 1:
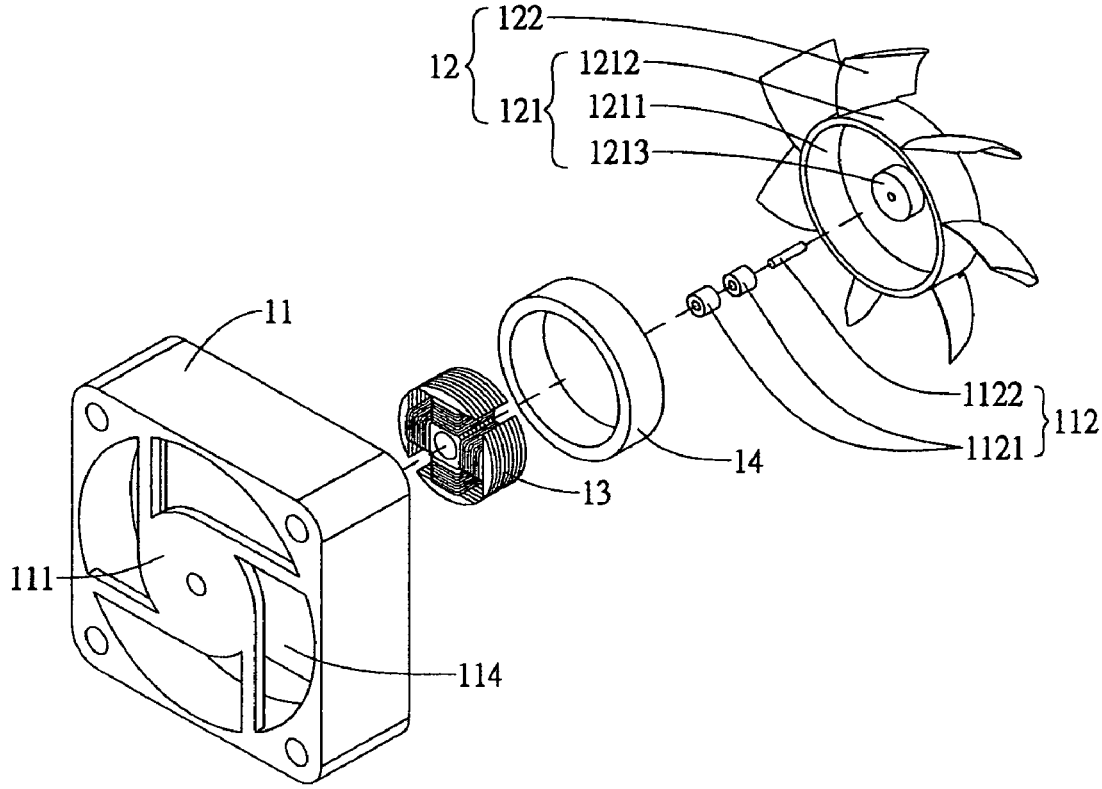
FIG 1 (PRIOR ART)
FIG. 1 is an exploded perspective view of the conventional fan.
Figure 2:
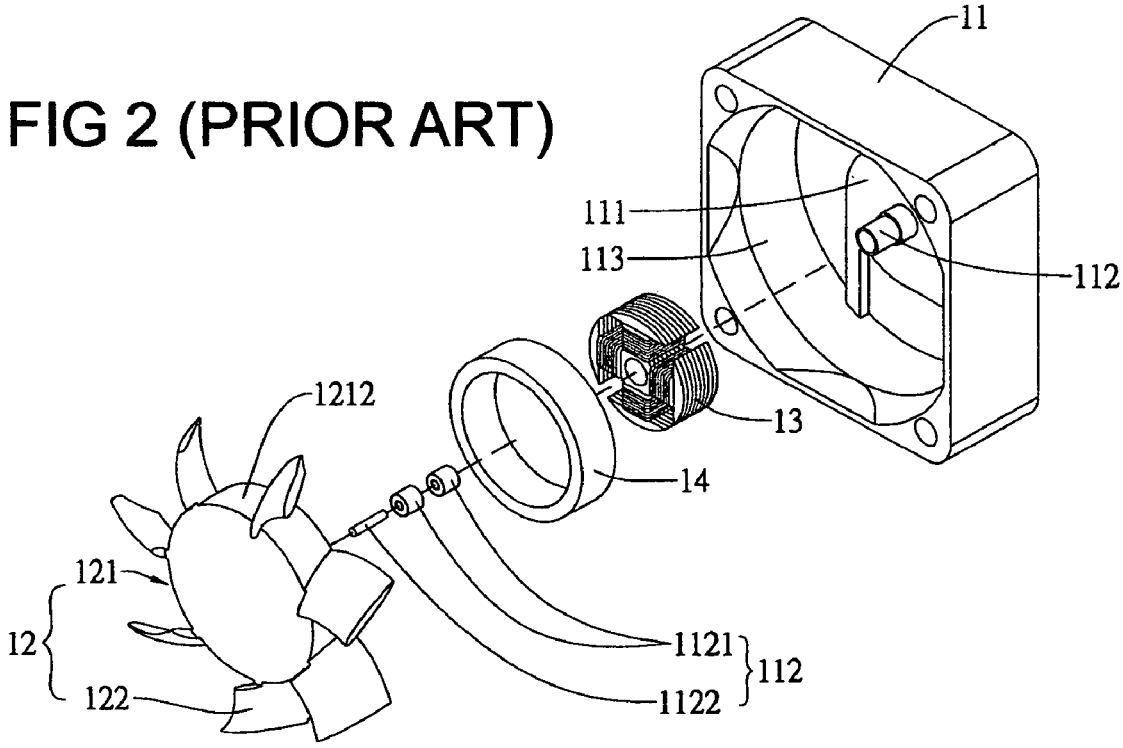
FIG 2 (PRIOR ART)
FIG. 2 is another exploded perspective view of the conventional fan.
Figure 5:
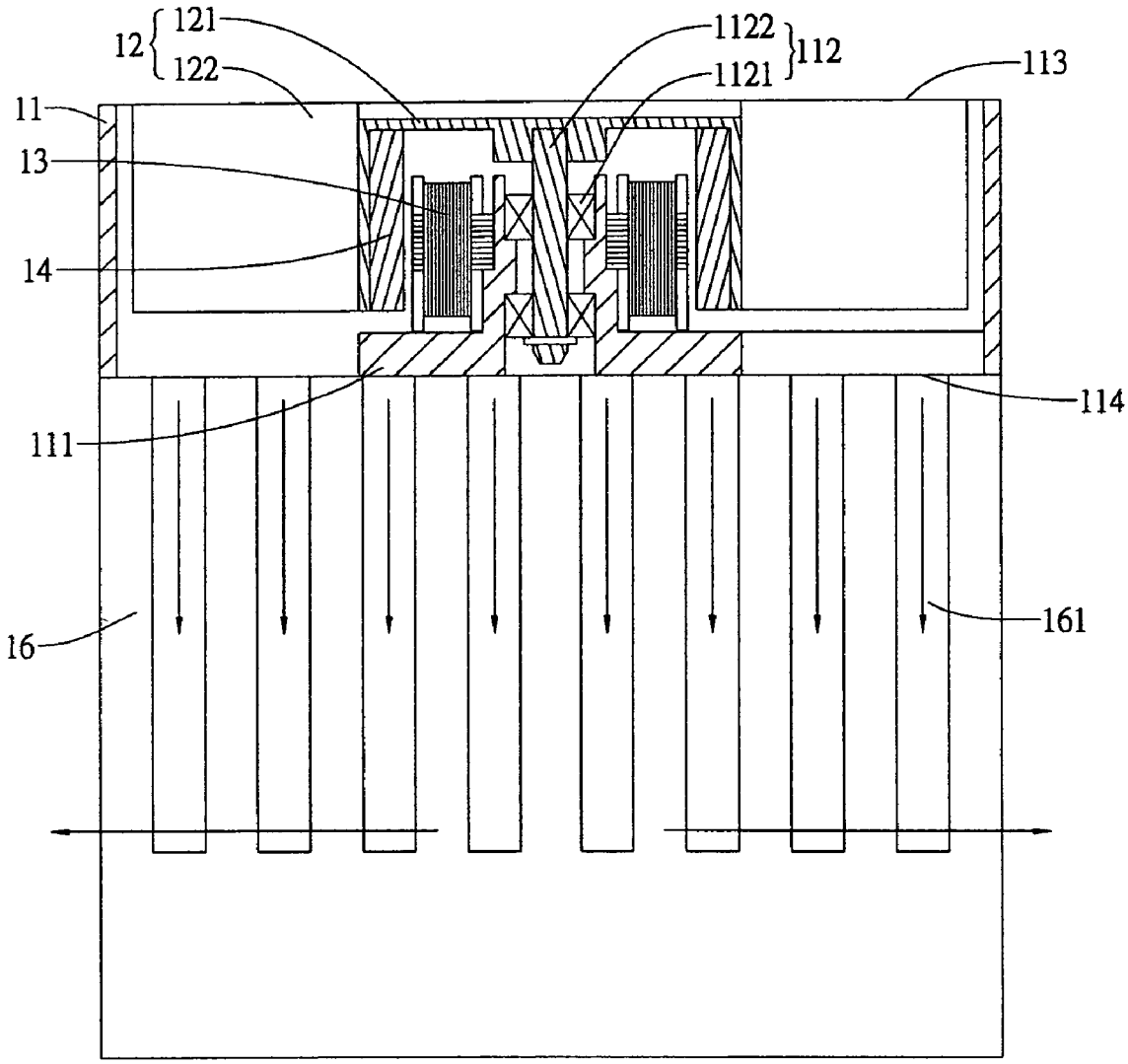
FIG 5 (PRIOR ART)
FIG. 5 is a sectional view of the conventional fan associated with a radiator illustrating the air being moved during the fan being in operation.

Referring to FIGS. 6 and 7, the first embodiment of a fan with central intake according to the present invention comprises a fan frame 21 and a fan wheel 22. The fan frame 21 provides an inlet 214 and an outlet 215. A hub seat 211 is located at the outlet 215 with an annular spacing 212 being disposed in the hub seat 211 between the inner circumferential wall surface and a joining part 213, which is disposed at the center of the hub seat fixedly attached to the hub seat with four radial joining bars for fluid being capable of moving through. The joining part 213 is cylindrical for supporting two bearings 2132 and a spindle 2131 rotatably fits with the bearings 2132 and an end of the spindle 2131 extends to the inlet 214 as an extending section. A motor stator 23 of a driving device, which is a fan motor, fits with the hub seat 211. The fan wheel 22 has a hub 221 with a short U shaped cross section and the hub 221 has an open side and a hub wall 2212 with a circular opening 2211 opposite to the open side. A plurality of blades 222 extend radially from the outer circumferential side of the hub 221. The blades 222 further extend forward and incline leftward toward the center of the hub 221 to connect with a receiving part 223, which is a journal and centrally disposed in front of the hub 221 viewed from the side of inlet 214. The receiving part 223 tightly fits with the extending section of the spindle 2131. The motor rotor 24 of the driving device is received in the hub 221.

While the fan of the present invention is in assembling, the hub 221 of the fan wheel 22 encloses the hub seat 211 of the fan frame 21. In the meantime, the motor rotor 24 is attached to the inner circumferential side of the hub 221 and the stator 23 is disposed surrounding the hub seat 211. The circular opening 2211 of the hub 221 and the annular spacing 212 of the hub seat 211 forms a central flow route for fluid passing through.

Referring to FIGS. 6, 8 and 9, when the stator 23 is powered on, the rotor is magnetized to turn leftward with the fan wheel 22 such that fluid is dragged into the inlet 214 of the fan frame 21 by the blades 222 and flows out via the outlet 215. The fluid passes through the central flow route not only to reduce stagnation zone behind the hub seat 211 but also to dissipate heat generated from rotations of the stator 23, the rotor 24 and the bearing 2132.

Referring to FIG. 10, an article, which is a radiator 26, for being cooled, is joined to the fan of the present invention. The fan frame 21 with the fan wheel 22 is mounted at the top of the radiator 26. Once the fan rotates, the fluid is moved inward via the inlet 214 and flows toward the radiator 26 at the outlet 215. Then, the fluid disperses outward via air clearances 261 in the radiator 26 such that heat in the radiator 26 can be carried with the fluid flowing outward via the outlet 215 and the fluid passing through the central flow route can dissipate a great deal of heat at the center of the radiator 26. Further, heat generated from rotations of the stator 23, the rotor 24 and the bearings 2132 can be brought outward as well. Thus, problems related to the heat at the center of the radiator being unable to be dissipated and the stagnation zone of heat being created behind the fan can be solved completely such that effect of heat dissipation and performance of the fan can be enhanced and life spans of the fan and the radiator can be prolonged advantageously.

Figure 12:
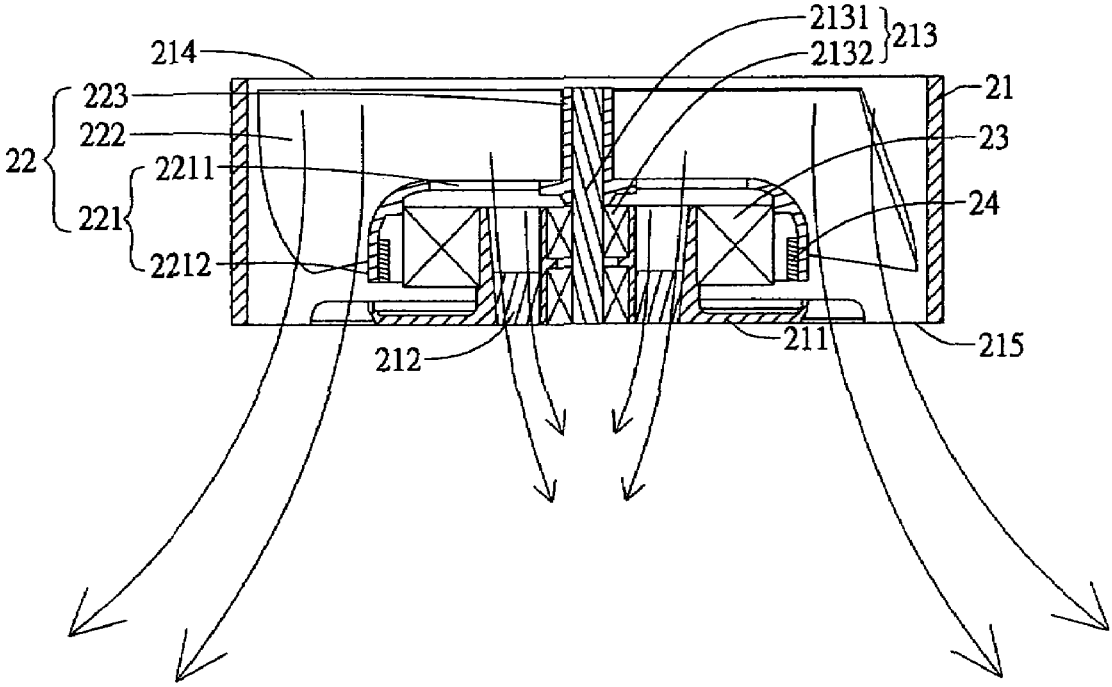
FIG. 12 is a sectional view illustrating the third type passage of the hub in the first embodiment of a fan with a radiator according to the present invention.

Referring to FIGS. 11 and 12, the annular spacing 212 of the hub seat 211 in the first embodiment can be diverged downward from the top or converged downward from the top to control outgoing fluid and extend flowing range or control the fluid flowing toward rear side of the joining part 213 so as to allow the fluid at the rear side of the joining part 213 keeping moving and prevent from creating the stagnation zone.

Figure 13:
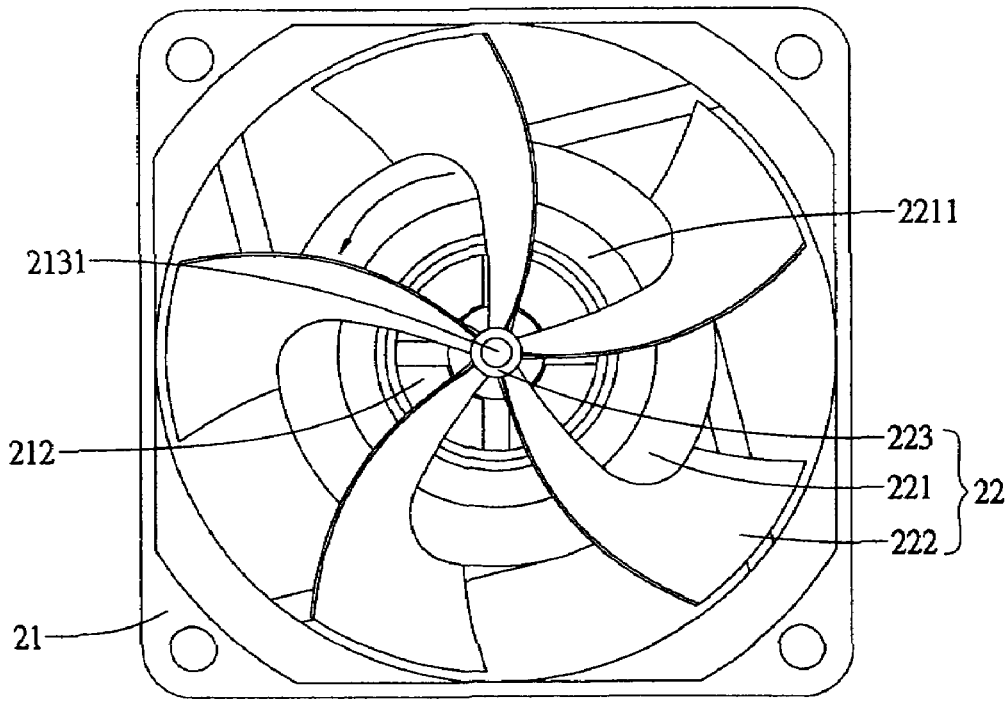
FIG. 13 is a top view illustrating the fan blade in the first embodiment of the present invention having a twist angle turning left.
Figure 18:
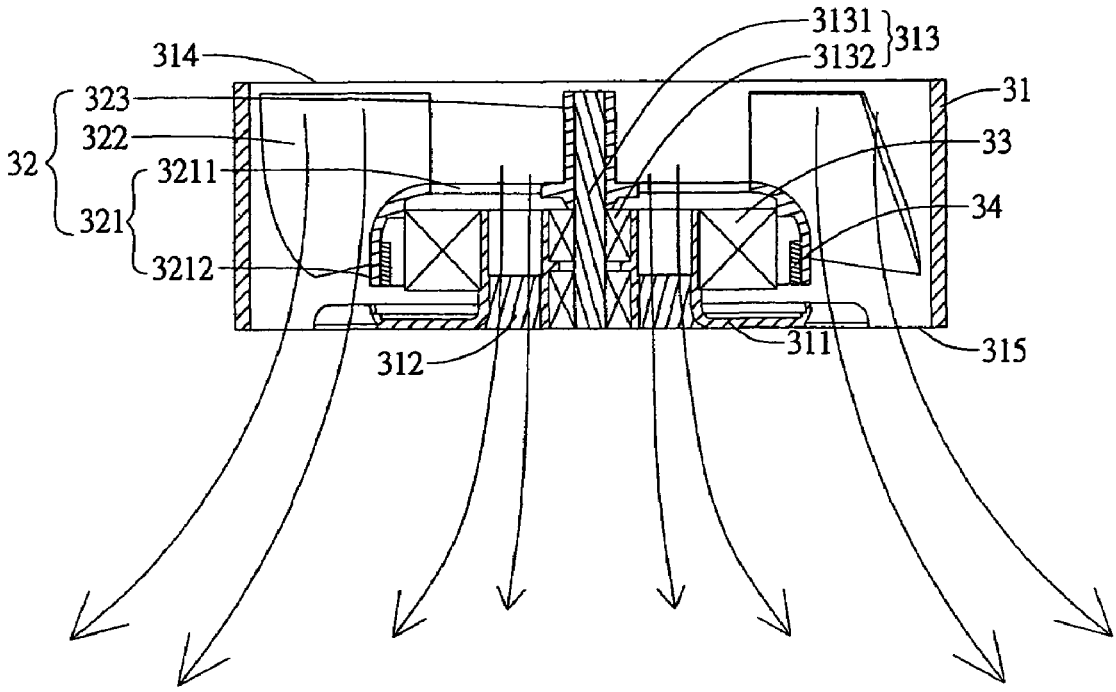
FIG. 18 is a sectional view of the second embodiment of a fan with central intake according to the present invention illustrating the air being moved during the fan being in operation.
Figure 19:
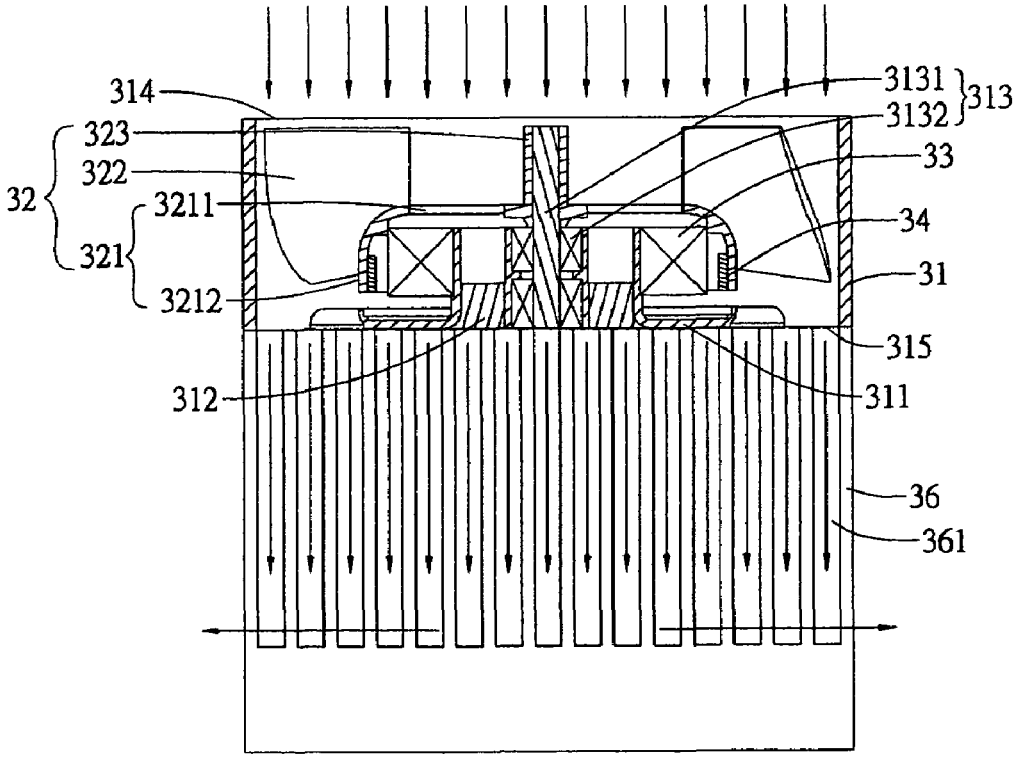
FIG. 19 is a sectional view of the second embodiment of the fan associated with a radiator according to the present invention.

Referring to FIGS. 13 and 14, the blades 222 of the fan wheel 22 in the first embodiment is provided to incline rightward. Under this circumstance, the hub seat 211 is arranged at the side of inlet 214 and the fan wheel 22 is arranged at the side of outlet 215. Hence, the fluid enters the hub seat 211 from the side of inlet 214 and flows toward the radiator 26 via the fan wheel 22 at the side of outlet 215. The same effect and function can be reached as well.

Referring to FIGS. 15 to 23, the second embodiment of a fan with central intake according to the present invention is illustrated. The overall structure and function of the second embodiment are about the same as the preceding embodiment. The difference of the present embodiment is in that the blades 322 extend radially from outer circumferential side of the hub 321 and a cylindrical receiving part 323 is provided centrally in front of the hub 321 with three radial joining bars 324 at an end thereof to be fixedly attached to the inner circumferential side of the hub 321. By way of fluid passing through the central flow route composed of the circular opening 3211 of the hub 321 and the annular spacing 312 of the hub seat 211, the stagnation zone behind the hub seat 311 can be reduced to dissipate heat at the center of the radiator 36 largely and heat generated from the stator 33, the rotor 34 and the bearings 3132 at the joining part 313.

Figure 26:
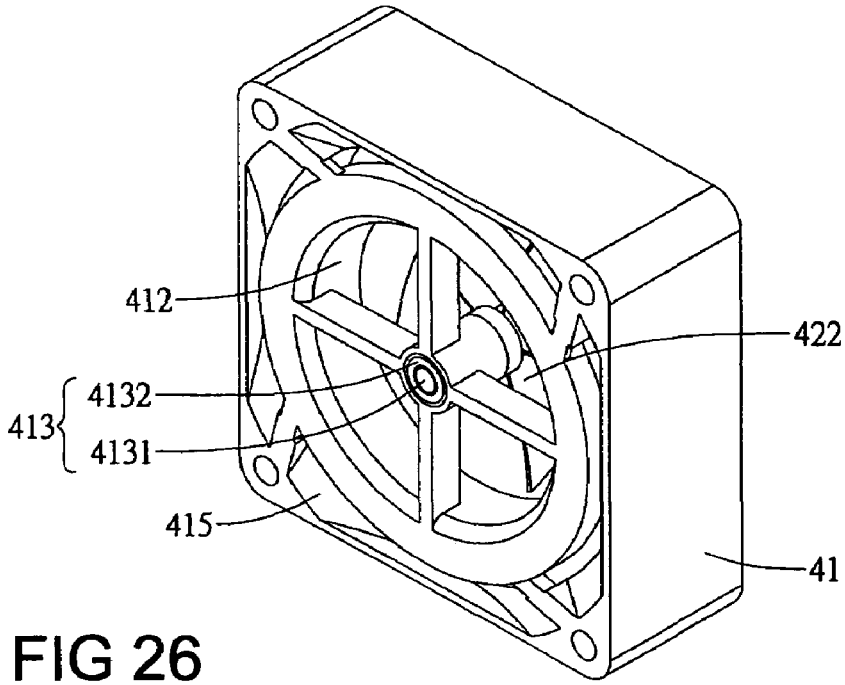
FIG. 26 is another assembled perspective view of the third embodiment of a fan with central intake according to the present invention.

Referring to FIGS. 24, 25 and 26, the third embodiment of a fan with central intake according to the present invention is illustrated. The third embodiment of a fan with central intake according to the present invention comprises a fan frame 41 and a fan wheel 42. The fan frame 41 provides an inlet 414 and an outlet 415. A hub seat 411 is located at the outlet 415 with an annular spacing 412 being disposed in the hub seat 411 between the inner circumferential side of the hub seat 411 and a cylindrical joining part 413 at the center of the hub seat 411. The joining part 413 is employed to support two bearings 4132 therein and the bearings 4132 fit with a spindle 4131. A motor stator 43 surrounds and fits with the hub seat 411. The fan wheel 42 has a hub 421, which has a short U shaped cross section, an open side and a circumferential side with a circular opening 4211 opposite to the open side and a plurality of blades 422 extend radially from the circular opening 4211 and further incline leftward to connect with a cylindrical receiving part 423, which is centrally disposed in front of the hub 421. The motor rotor 44 is received in and attached to the inner circumferential side of the hub 421.

While the fan of the present embodiment is in assembling, the hub 421 encloses the hub seat 411 and the receiving part 423 tightly fits with the extending section of the spindle 4131. In the meantime, the motor rotor 44 is disposed opposite to the stator 43 and the circular opening 4211 of the hub 421 and annular spacing 412 of the hub seat 411 form a central flow route for fluid passing through.

Figure 27:
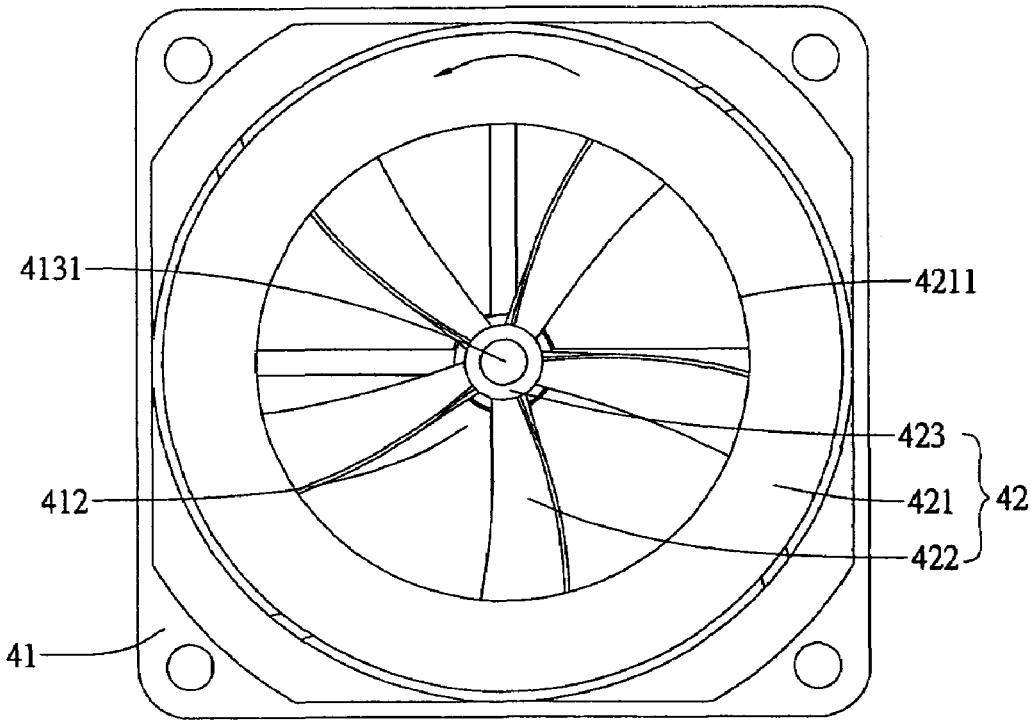
FIG. 27 is a top view of the third embodiment of a fan with central intake according to the present invention.
Figure 28:
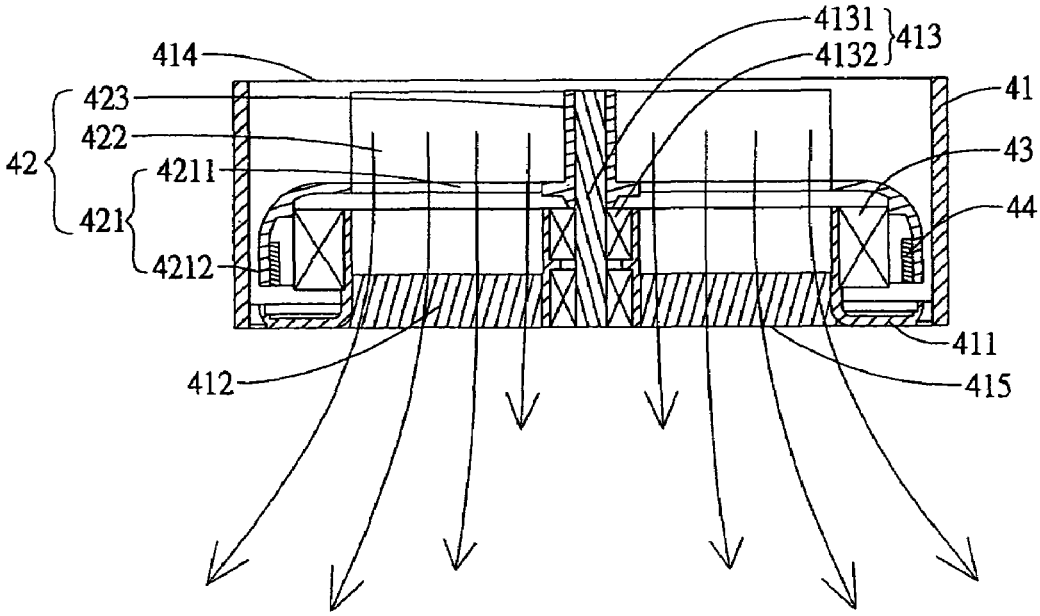
FIG. 28 is a sectional view of the third embodiment of a fan with central intake according to the present invention illustrating the air being moved during the fan being in operation.

Referring to FIGS. 24, 27 and 28, when the stator 43 is powered on, the rotor is magnetized to turn leftward with the fan wheel 42 such that fluid is dragged into the inlet 414 of the fan frame 41 by the blades 422 and flows out via the outlet 415. The fluid passes through the central flow route not only to reduce stagnation zone behind the hub seat 411 but also to dissipate heat generated from rotations of the stator 43, the rotor 44 and the bearing 4132.

Figure 29:
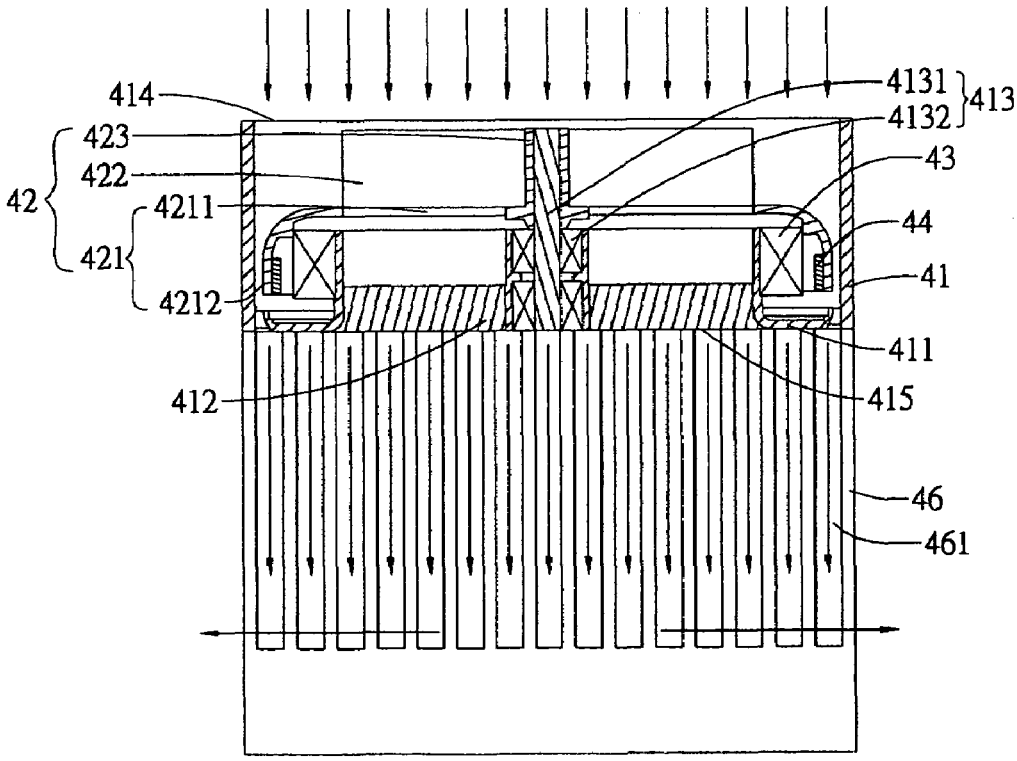
FIG. 29 is a sectional view of the third embodiment of the fan associated with a radiator according to the present invention.

Referring to FIG. 29, an article, which is a radiator 46 for being cooled, is joined to the fan of the present embodiment. The fan frame 41 with the fan wheel 42 is mounted at the top of the radiator 46. The fluid moves inward via the inlet 214 and passes through the central flow route and then flows toward the radiator 46 at the outlet 415 during the fan wheel 42 rotating. Thus, the fluid disperses outward via air clearances 461 of the radiator 46 such that heat in the radiator 46 can be carried with the fluid flowing outward via the outlet 415 and the fluid passing through the central flow route can dissipate a great deal of heat at the center of the radiator 46. Further, heat generated from rotations of the stator 43, the rotor 44 and the bearing 4132 can be brought outward as well. Hence, problems related to heat at the center of the radiator being unable to be dissipated and the stagnation zone created behind the hub can be solved to enhance heat dissipation effect and performance of the fan for extending the life spans of the fan and the radiator.

Referring to FIGS. 30 and 31, the annular spacing 412 of the hub seat 411 in the third embodiment can be diverged downward from the top or converged downward from the top to control outgoing fluid and extend flowing range or control the fluid flowing toward rear side of the joining part 413 so as to allow the fluid at the rear side of the joining part 413 to keep moving and prevent from creating the stagnation zone.

Referring to FIGS. 32 and 33, the blades 422 of the fan wheel 42 in the third embodiment is provided to incline rightward. Under this circumstance, the fluid enters the hub seat 411 from the side of the inlet and flows toward the radiator 46 via the side of the outlet so that the same effect and function can be reached as well.

While the invention has been described with referencing to preferred embodiments thereof, it is to be understood that modifications or variations may be easily made without departing from the spirit of this invention, which is defined by the appended claims.

What is claimed is:

1. A fan with central intake comprising:

a fan frame with an inlet side and an outlet side;

a cylindrical hub seat being disposed at the center of the outlet side and fixedly joined to the fan frame, providing a cylindrical central joining part therein and four joining bars being arranged to join the inner wall surface of the hub seat and the outer surface of the joining part such that an annular spacing is formed between the hub seat and the joining part;

at least two bearings being disposed in and fitting with the joining part;

a spindle rotatably fitting with the bearings with an extending section reaching the inlet side;

a fan wheel being received in the fan frame, having a hub with a short U shaped cross section, an open side facing the hub seat and a hub wall with a circular opening being opposite to the open side, and having a plurality of blades, which extend from hub; and a fan motor providing a rotor joined to the inner circumferential side of the hub and a stator between the hub and the hub seat;

characterized in that the blades radially extend from the outer circumferential side of the hub to allow an end of the respective blade joining a cylindrical receiving part, which is centrally disposed in front of the hub to tightly fit with the extending section of the spindle; and both the annular spacing and the circular opening constitute a central flow route available for passing fluid.

2. A fan with central intake comprising:

a fan frame with an inlet side and an outlet side;

a cylindrical hub seat being disposed at the center of the outlet side and fixedly joined to the fan frame, providing a cylindrical central joining part therein and four joining bars being arranged to join the inner wall surface of the hub seat and the outer surface of the joining part such that an annular spacing is formed between the hub seat and the joining part;

at least two bearings being disposed in and fitting with the joining part;

a spindle rotatably fitting with the bearings with an extending section reaching the inlet side;

a fan wheel being received in the fan frame, having a hub with a short U shaped cross section, an open side facing the hub seat and a hub wall with a circular opening being opposite to the open side and having a plurality of blades extend from hub; and a fan motor providing a rotor joined to the inner circumferential side of the hub and a stator between the hub and the hub seat;

characterized in that the blades radially extend from the outer circumferential side of the hub and a cylindrical receiving part, which is centrally disposed in front of the hub and joined to the inner circumferential side of the hub, tightly fits with the extending section of the spindle; and both the annular spacing and the circular opening constitute a central flow route available for passing fluid.

3. A fan with central intake comprising:

a fan frame with an inlet side and an outlet side;

a cylindrical hub seat being disposed at the center of the outlet side and fixedly joined to the fan frame, providing a cylindrical central joining part therein and four joining bars being arranged to join the inner wall surface of the hub seat and the outer surface of the joining part such that an annular spacing is formed between the hub seat and the joining part;

at least two bearings being disposed in and fitting with the joining part;

a spindle rotatably fitting with the bearings with an end thereof extending to the inlet side;

a fan wheel being received in the fan frame, having a hub with a short U shaped cross section, an open side facing the hub seat and a hub wall with a circular opening being opposite to the open side and having a plurality of blades extending from hub; and a fan motor providing a rotor joined to the inner circumferential side of the hub and a stator between the hub and the hub seat;

characterized in that the blades radially extend from the circumference of the circular opening and radially inward to join a cylindrical receiving part, which is centrally disposed in front of the hub, tightly fits with the extending section of the spindle; and both the annular spacing and the circular opening constitute a central flow route available for passing fluid.

* * * * *